United States Patent [19]

Fink et al.

[11] 4,455,342

[45] Jun. 19, 1984

[54] ACRYLIC RESIN DISPERSIONS

[75] Inventors: Herbert Fink, Bickenbach; Heiner Kniese, Seeheim-Jugenheim; Norbert Suetterlin, Ober-Ramstadt; Klaus Mueller, Gross-Bieberau; Werner Siol, Darmstadt, all of Fed. Rep. of Germany

[73] Assignee: Röhm GmbH, Darmstadt, Fed. Rep. of Germany

[21] Appl. No.: 455,660

[22] Filed: Jan. 5, 1983

[30] Foreign Application Priority Data

Jan. 23, 1982 [DE] Fed. Rep. of Germany ..... 3202093

[51] Int. Cl.[3] ..... C08F 20/00

[52] U.S. Cl. ..... 428/265; 427/389.9; 428/480; 428/483; 428/290; 428/262; 428/254; 428/253; 524/555; 524/831; 526/307.5

[58] Field of Search ..... 524/555, 831; 526/307.5; 427/389.9; 428/290, 262, 265, 254, 253, 480, 483

[56] References Cited

U.S. PATENT DOCUMENTS 4,036,788 7/1977 Steckler ..... 526/260

4,305,860 12/1981 Jovine et al. ..... 526/295

FOREIGN PATENT DOCUMENTS 12032 6/1980 European Pat. Off. .

12033 6/1980 European Pat. Off. .

*Primary Examiner*—Paul R. Michl

*Assistant Examiner*—Alex H. Walker

*Attorney, Agent, or Firm*—Curtis, Morris & Safford

[57] ABSTRACT

What are disclosed are aqueous dispersions of an acrylic resin which is suitable for the reinforcement of fibrous articles and is free of formaldehyde and acrylonitrile, said resin comprising (a) from 70 to 96.95 weight percent of alkyl esters of acrylic acid and/or methacrylic acid, or mixtures of such esters with styrene; (b) from 2 to 30 weight percent of an hydroxyalkyl ester of an unsaturated carboxylic acid; (c) from 1 to 10 weight percent of acrylamide or of methacrylamide; (d) from 0.05 to 3 weight percent of a crosslinking comonomer having at least two polymerizable double bonds; (e) up to 5 weight percent of an unsaturated carboxylic acid; and (f) up to 20 weight percent of one or more further monomers, as well as fibrous articles reinforced with such a resin dispersion and showing reduced loss of resin binder on dry cleaning and reduced absorption of plasticizers, and methods of making such articles.

6 Claims, No Drawings

ACRYLIC RESIN DISPERSIONS

The present invention relates to aqueous dispersions of synthetic resins which contain no formaldehyde and no acrylonitrile and do not liberate these substances when the dispersion or the resin is heated; the invention further relates to the use of these dispersions for the reinforcement of textiles.

For reinforcing or strengthening textiles, the prior art employs acrylic resin dispersions which contain N-methylolamide groups or formaldehyde condensation resins as a crosslinking agent and/or whose resin component may be composed in part of acrylonitrile. These dispersions or the resin contained therein liberate, at least on being heated, small amounts of formaldehyde or acrylonitrile. This is undesirable, especially if products finished with the resins are to be used in the food or clothing sector. It has heretofore been believed that substances giving off acrylonitrile or formaldehyde had to be incorporated into such resins in order to impart adequate resistance to dry cleaning fluids to the products finished with these dispersions.

Thus, there has been a need for aqueous dispersions of synthetic resins which are free of formaldehyde, of formaldehyde-liberating substances, and of acrylonitrile, but which can nevertheless be used to produce reinforced fibrous articles which are resistant to dry cleaning fluids.

Published European patent application No. 12032 discloses an acrylate dispersion which is suitable for the reinforcement of predominantly hydrophilic fibrous articles and is free of formaldehyde and acrylonitrile. The resin component of the dispersion is formed largely of monomers imparting softness, such as higher acrylate and methacrylate esters, the rest being monomers imparting hardness, such as styrene or methyl methacrylate, and an unsaturated carboxylic acid. Such dispersions have long been known. Textile fabrics finished with them have the drawback of possessing little resistance to the solvents used in dry cleaning. The composition of the dispersed plastic may include acrylamide or methacrylamide, or hydroxyalkyl esters of acrylic acid or of methacrylic acid, or mixtures thereof, as further comonomers. However, the resistance to organic solvents is not substantially improved thereby. Fibrous articles reinforced with these binders therefore cannot be used for purposes where they come into contact with organic solvents or plasticizers, or with plastic articles made therewith. Similar binders proposed in published European patent application No. 12033 for hydrophobic fibrous articles have the same drawbacks.

The object of the present invention is to improve acrylic resin dispersions which are suitable for the reinforcement of fibrous articles and which are free of acrylonitrile and formaldehyde in such a way that fibrous articles reinforced therewith possess adequate resistance to the solvents used in dry cleaning and to plasticizers. The properties of fibrous articles produced with conventional self-crosslinking acrylic resin dispersions may be used as a measure of adequate resistance. The resins in these dispersions always contain N-methylolamide groups which may give off small amounts of formaldehyde and, in many cases, the resins may give off acrylonitrile.

A feature of the invention is an aqueous dispersion of a resin achieving this object, said resin comprising (a) 70 to 96.95 weight percent of at least one member selected from the group consisting of alkyl esters of acrylic acid and of methacrylic acid having from 1 to 18 carbon atoms in the alkyl group, and mixtures of such esters with styrene;

(b) 2 to 30 weight percent of an hydroxyalkyl ester of an unsaturated polymerizable monocarboxylic or dicarboxylic acid having at least 2 carbon atoms in the hydroxyalkyl group;

(c) 1 to 10 weight percent of acrylamide or of methacrylamide;

(d) 0.05 to 3 weight percent of a crosslinking comonomer having at least two polymerizable double bonds;

(e) 0 to 5 weight percent of an unsaturated polymerizable monocarboxylic or dicarboxylic acid; and (f) 0 to 20 weight percent of at least one further comonomer free of nitrile groups and of groups capable of liberating formaldehyde.

In Table I which follows, the results of evaluations obtained under standardized testing conditions from textile fabrics which had been reinforced with various binders are compared. One of these tests involved the determination of the loss of binder on dry cleaning with trichloroethylene at 20° C. In the other test, the swelling of a polymer film upon immersion for 4 hours in methyl isobutyl ketone at room temperature was determined. This latter test establishes sensitivity to plasticizers. In both cases, low values are desirable.

Resins according to the present invention, a conventional self-crosslinking acrylic resin, and various other acrylic resins which were free of substances giving off acrylonitrile and formaldehyde and which had been prepared from a mixture of higher acrylate and methacrylate esters, an hydroxyalkyl ester, an unsaturated carboxylic acid, and, optionally, with acrylamide, were used as binders. It was found that the sensitivity of the reinforced fibrous articles to organic dry cleaning fluids and plasticizers is considerably higher using these last-mentioned dispersions than when known self-crosslinking acrylic dispersions are used. This sensitivity renders the articles unfit for practical use.

The test specimens used in the determination of the loss of binder were a woven polyester fabric impregnated with 50 weight percent of resin binder and dried at 80° C.; in the determination of the methyl isobutyl ketone absorption, polymer films 0.5 mm thick and measuring 30×30 mm, obtained by drying the resin dispersions at 35° C. and further condensing them for 5 minutes at 140° C., were used.

TABLE I

| Resin dispersion | | | | | | Binder loss upon treatment with trichloroethylene (percent) | Methyl isobutyl ketone absorption in 4 hr. at 20° C. (percent based on binder content) |
|---|---|---|---|---|---|---|---|
| Commercial self-crosslinking acrylic resin dispersion; 92% EA, 5% MMAA, 3% MAA | | | | | | 6 | 70 |
| Dispersion of | | | | | | | |
| BMA | BA | HEA | MMA | MA | AMA | | |
| 70.2 | 18.8 | 10 | — | 1 | — | 31 | 340 |
| 70 | 19 | 5 | 5 | 1 | — | 19 | 400 |
| 65 | 19 | 10 | 5 | 1 | — | 19 | 290 |
| 75 | 18.8 | 5 | — | 1 | 0.2 | 27 | 260 |
| Dispersions in accordance with the present invention | | | | | | | |
| 64.8 | 19 | 10 | 5 | 1 | 0.2 | 7 | 170 |

TABLE I-continued

| | | | | | | | |
|---|---|---|---|---|---|---|---|
| 63.8 | 19 | 10 | 5 | 2 | 0.2 | 3 | 160 |

Key:
EA = Ethyl acrylate
MMAA = N—methylol methacrylamide
MAA = Methacrylamide
BMA = n-butyl methacrylate
BA = n-butyl acrylate
HEA = Hydroxyethyl acrylate
MA = Methacrylic acid
AMA = Allyl methacrylate Surprisingly, the resistance to organic dry cleaning fluids and plasticizers is substantially increased when the binder includes a small amount of a multifunctional crosslinking agent. It is known, of course, that the resistance of a binder to organic solvents and plasticizers can be improved by crosslinking. However, since crosslinking impairs film formation, it has heretofore been regarded as essential to bring about crosslinking, for example by means of N-methylolamide groups, only following film formation. The resins in accordance with the present invention are therefore crosslinked only to such an extent that satisfactory film formation is still possible. It was not to be expected that such slight crosslinking would have an advantageous effect on resistance to organic solvents and plasticizers. In fact, the increased resistance is due not only to the crosslinking but also to a synergistic cooperative action of the crosslinking agent with amide groups and the hydroxyalkyl ester groups present in the resin. While it is not known how this synergism comes about, it has been found that each of said three constituents is essential to the high resistance obtained.

Because of the increased resistance to organic solvents and plasticizers of the films produced from the dispersions in accordance with the invention, the new dispersions can be used successfully wherever self-crosslinking acrylic resin dispersions containing N-methylolamide groups have been used up to now. A preferred use is for the reinforcement of textiles.

The predominant component (a) of the dispersed resins of the invention is formed of alkyl acrylate and or methacrylate esters, which esters may be replaced in part, but not to the extent of more than one-half, by styrene. Of the alkyl acrylate and methacrylate esters, those having at least 4 carbon atoms in the alkyl group, and especially n-butyl acrylate and methacrylate and 2-ethylhexyl acrylate, are particularly preferred. High proportions of these esters assure a low minimum film forming temperature (in conformity with DIN 53787) and a low dynamic glass transition temperature (in conformity with DIN 53445). The minimum film forming temperature of the resins is preferably below 70° C. and the dynamic glass transition temperature of films made therefrom is preferably below 40° C. These values are essentially determined by the selection of the ester component (a). As is known, styrene and the lower alkyl esters of methacrylic acid have the effect of raising these values, whereas acrylate esters and higher methacrylate esters tend to lower them.

Esters of acrylic acid, methacrylic acid, maleic acid, fumaric acid, and itaconic acid are suitable for use as hydroxyalkyl ester component (b). These esters contain at least 2 carbon atoms, and generally not more than 12 and preferably not more than 4 carbon atoms, in the hydroxyalkyl group. Preferred monomers of this kind are hydroxyalkyl acrylate and methacrylate, 2-hydroxypropyl acrylate and methacrylate, and 4-hydroxybutyl acrylate and methacrylate. Component (b) preferably comprises from 3 to 15 weight percent of the copolymer.

Acrylamide and/or methacrylamide are used in an amount of from 1 to 10, and preferably from 2 to 6, weight percent.

Compounds having at least two polymerizable carbon-carbon double bonds of the same or different reactivity, are suitable for use as crosslinking comonomers (d). Examples of compounds wherein the polymerizable bonds are of the same reactivity are acrylate and methacrylate esters of glycols such as ethylene glycol, diethylene glycol, and 1,4-butanediol; methylenebis acrylamide and methacrylamide; divinylbenzene; diallyl phthalate; and triallyl cyanurate. Crosslinking monomers wherein the double bonds have different reactivities are vinyl methacrylate, allyl acrylate, and allyl methacrylate, for example. The amount of the crosslinking comonomer depends on its crosslinking effectiveness, which in turn is a function of the reactivity of the double bonds and of the molecular weight of the monomer. When used in an amount of less than 0.05 weight percent, based on the weight of the copolymer, the desired improvement in solvent resistance usually is not fully obtained, whereas an amount greater than 3 weight percent may interfere with film formation. Over the range from 0.5 to 3 weight percent, the solvent resistance of the film increases with crosslinking and is appropriately selected to be as high as it can be without impairing film formation. The preferred content of cross-linking monomers ranges from 0.1 to 1 weight percent.

It is not essential that the composition of the copolymer include unsaturated carboxylic acids. However, their presence in an amount up to 5 weight percent, e.g. from about 0.5 to 5 weight percent, based on the weight of the copolymer, may improve the stability of the dispersion. Amounts ranging from 0.5 to 3 weight percent will usually suffice for this purpose. Acrylic or methacrylic acids are preferably used. Other unsaturated polymerizable mono- or dicarboxylic acids which may be used are crotonic acid, maleic acid, fumaric acid, and itaconic acid.

The composition of the copolymer may include further monomers in limited amounts not exceeding 20 weight percent, e.g. from about 0.5 to 20 weight percent, provided that these are not acrylonitrile or methacrylonitrile and that no formaldehyde-liberating groups are contained in them. As the term is used herein, "formaldehyde-liberating groups" refers to groups which may result in the liberation of formaldehyde at least on heating. Such groups include primarily N-methylolamide groups and masked methylol groups such as Mannich bases or N-amide methylolalkyl ethers. For the purposes of the invention, additional monomer components (f) usually are not necessary but may be advisable when used for a specific purpose. An example is the inclusion of N-vinylimidazole or of dialkylaminoalkyl esters of acrylic or methacrylic acid or of their salts. Used in amounts from 1 to 5 weight percent, for example, these comonomers will improve the affinity of the plastic for cellulose fibers. Examples of further comonomers which may be used concurrently for other purposes are N-vinylpyrrolidone, vinyl acetate and other vinyl esters, vinyl choloride, vinylidene chloride, butadiene, ethylene and propylene.

The dispersions in accordance with the invention may be prepared by conventional emulsion polymerization methods in the presence of the usual anionic, nonionic, or cationic emulsifying agents and of water soluble free radical forming initiators. Anionic emulsifiers, or combinations of anionic and nonionic emulsifiers, are preferably used. The average particle diameter (weight average) may range from 20 to 2000 nm (nanometers) and preferably ranges from 100 to 500 nm. The solids content is preferably between 50 and 70 percent of the total weight of the dispersion.

The preferred field of use of the dispersions of the invention is the reinforcement of textiles. These include nonwoven fabrics, wadding, and woven and knitted fabrics made of natural or synthetic fibers or blends thereof. Amounts ranging from 1 to over 100 weight percent of resin, based on the weight of the fiber, may be used for reinforcement, for example. For the reinforcement of nonwovens, from 10 to 30 weight percent is preferably used. The method of application depends as usual on the nature of the fibrous article and on the amount of dispersion to be applied.

The usual methods of application, such as spraying, impregnation, padding, knife coating, etc., may be employed conventionally. Drying of the treated fibrous material should be carried out at temperatures above 100° C. and preferably in the range of 120° to 160° C.

Other flat substrates such as paper, wood, plastic foils, sheet metal, etc., may be coated with the dispersions in accordance with the invention, optionally after pigmenting, and then dried, also at temperatures above 100° C. During drying, the film solidifies and acquires its high resistance to organic solvents and organic plasticizers.

A better understanding of the present invention will be had by referring to the following specific examples, given by way of illustration.

EXAMPLES 1-6

Procedure for Preparing the Dispersions 155 parts of fully desalinated water were heated with stirring to 80° C. in a 1-liter round-bottom flask equipped with stirrer and contact thermometer and mixed with 0.16 part of a 90% sulfonated, ethoxylated alkylarylol-maleic acid emulsifying agent dissolved in 5 parts of butyl methacrylate, and with 5 parts of a 4% ammonium persulfate initiator solution. After an interval of 4 minutes, an emulsion of:

240 parts of fully desalinated water,
1 part of 90% sulfonated, ethoxylated alkylarylol-maleic acid,
0.9 part of ammonium persulfate, and
395 parts of the monomer mixture specified infra were then added dropwise at 80° C. over a period of 4 hours. The temperature was then held at 80° C. for another 2 hours. The charge was then cooled to room temperature and the pH value adjusted to 2.2 by the addition of phosphoric acid.

Stable, coagulate free dispersions were so obtained. The resins in these dispersions all had an MFT below 20° C.

In Table II which follows, the two right-hand columns give the results of tests of the practical usefulness of the dispersions. "BL" is the binder loss (in percent, based on the weight of the binder) of a polyester fabric reinforced with 50 percent of binder (based on the weight of the fiber) upon treatment with trichloroethylene in a laboratory washing machine. "MIBK Absorption" gives the swelling upon immersion in methyl isobutyl ketone for 4 hours at 20° C. in percent, based on the weight of the binder. The conditions for preparing the test samples were the same as those reported for Table I.

EXAMPLES 7-11

Procedure for Preparing the Dispersions 155 parts of fully desalinated water and 0.06 part of an emulsifier obtained by reacting 1 mole of tributylphenol with 7 moles of ethylene oxide, sulfating, and converting the product to the sodium salt, were heated with stirring to 80° C. in a 1-liter round-bottom flask equipped with stirrer and contact thermometer and mixed with 5 parts of 4% ammonium persulfate solution. To this there was then added dropwise over a period of 4 hours at 80° C. an emulsion of:

240 parts of fully desalinated water,
2 parts of the emulsifier described above,
0.9 parts of ammonium persulfate, and
400 parts of the monomer mixture specified infra.

The temperature was then held at 80° C. for another 2 hours. The charge was then cooled to room temperature and the pH value adjusted to 2.2 by the addition of phosphoric acid.

Stable, coagulate free dispersions were so obtained. The resins in these dispersions all had an MFT below 30° C.

Example 1 (in accordance with the invention)

| Composition (parts by weight) | BL | MIBK Absorption |
|---|---|---|
| 254.2 butyl methacrylate<br>76 butyl acrylate<br>40 2-hydroxyethyl acrylate<br>20 methacrylamide<br>4 methacrylic acid<br>0.8 allyl methacrylate | 7 | 170 |

Example 2 (in accordance with the invention)

| Composition (parts by weight) | BL | MIBK Absorption |
|---|---|---|
| 250.2 butyl methacrylate<br>76 butyl acrylate<br>40 2-hydroxyethyl acrylate<br>20 methacrylamide<br>8 methacrylic acid<br>0.8 allyl methacrylate | 3 | 160 |

Example 3 (comparative test without crosslinking comonomer)

| Composition (parts by weight) | | MIBK Absorption |
|---|---|---|
| 255 butyl methacrylate<br>76 butyl acrylate<br>40 2-hydroxyethyl acrylate<br>20 methacrylamide<br>4 methacrylic acid | 18 | 290 |

Example 4 (comparative test without crosslinking comonomer)

| Composition (parts by weight) | | MIBK Absorption |
|---|---|---|
| 275 butyl methacrylate<br>76 butyl acrylate<br>20 2-hydroxyethyl acrylate<br>20 methacrylamide | 19 | 400 |

-continued

Example 4 (comparative test without crosslinking comonomer)

| Composition (parts by weight) | MIBK Absorption |
|---|---|
| 4 methacrylic acid | |

Example 5 (comparative test without crosslinking comonomer and without amide component)

| Composition (parts by weight) | BL | MIBK Absorption |
|---|---|---|
| 275.8 butyl methacrylate<br>75.2 butyl acrylate<br>40 2-hydroxyethyl acrylate<br>4 methacrylic acid | 31 | 340 |

Example 6 (comparative test without amine component)

| Composition (parts by weight) | BL | MIBK Absorption |
|---|---|---|
| 295 butyl methacrylate<br>75.2 butyl acrylate<br>20 2-hydroxyethyl acrylate<br>4 methacrylic acid<br>0.8 allyl methacrylate | 27 | 260 |

Example 7

| Composition (parts by weight) | BL | MIBK Absorption |
|---|---|---|
| 188 methyl methacrylate<br>148 butyl acrylate<br>40 2-hydroxyethyl acrylate<br>20 methacrylamide<br>3.2 methacrylic acid<br>0.8 allyl methacrylate | 6 | 150 |

Example 8

| Composition (parts by weight) | BL | MIBK Absorption |
|---|---|---|
| 179.2 ethyl acrylate<br>160 methyl methacrylate<br>40 2-hydroxyethyl acrylate<br>20 methacrylamide<br>0.8 allyl methacrylate | 5 | 140 |

Example 9

| Composition (parts by weight) | BL | MIBK Absorption |
|---|---|---|
| 176 ethyl acrylate<br>160 styrene<br>40 2-hydroxyethyl acrylate<br>20 methacrylamide<br>3.2 methacrylic acid | 6 | 160 |

-continued

Example 9

| Composition (parts by weight) | BL | MIBK Absorption |
|---|---|---|
| 0.8 allyl methacrylate | | |

Example 10

| Composition (parts by weight) | BL | MIBK Absorption |
|---|---|---|
| 188 methyl methacrylate<br>144 butyl acrylate<br>40 2-hydroxyethyl acrylate<br>20 acrylamide<br>4 methacrylic acid<br>4 1,4-butanediol dimethacrylate | 8 | 180 |

Example 11

| Composition (parts by weight) | BL | MIBK Absorption |
|---|---|---|
| 187.2 methyl methacrylate<br>148 butyl acrylate<br>40 2-hydroxyethyl acrylate<br>20 methacrylamide<br>4 methacrylic acid<br>0.8 allyl methacrylate | 7 | 160 |

What is claimed is:

1. The method of reinforcing a textile which comprises applying an aqueous dispersion which is free of formaldehyde, formaldehyde-liberating substances, and acrylonitrile to said textile in an amount from 1 to 100 percent by weight of the fibers in said textile and then drying said textile at a temperature above 100° C., said dispersion comprising an aqueous phase and a copolymer dispersed therein, said copolymer comprising
   (a) 70 to 96.25 weight percent of at least one member selected from the group consisting of alkyl esters of acrylic acid and of methacrylic acid having from 1 to 18 carbon atoms in the alkyl group, and mixtures of such esters with styrene;
   (b) 2 to 30 weight percent of an hydroxyalkyl ester of an unsaturated polymerizable monocarboxylic or dicarboxylic acid having at least 2 carbon atoms in the hydroxyalkyl group;
   (c) 1 to 10 weight percent of acrylamide or of methacrylamide;
   (d) 0.05 to 3 weight percent of a crosslinking comonomer having at least two polymerizable double bonds;
   (e) 0 to 5 weight percent of an unsaturated polymerizable monocarboxylic or dicarboxylic acid; and
   (f) 0 to 20 weight percent of at least one further comonomer free of nitrile groups and formaldehyde-liberating groups.

2. A method as in claim 1, wherein said copolymer has a minimum film forming temperature below 70° C.

3. A method as in claim 1, wherein copolymer has a dynamic glass transition temperature below 40° C.

4. A textile made by the method of claim 1.

5. A textile made by the method of claim 2.

6. A textile made by the method of claim 3.

* * * * *